United States Patent [19]

Malm

[11] 4,221,490

[45] Sep. 9, 1980

[54] TWO ENDED RETRACTABLE WRITING INSTRUMENT

[75] Inventor: Curtis L. Malm, Quincy, Mass.

[73] Assignee: The Gillette Company, Boston, Mass.

[21] Appl. No.: 965,205

[22] Filed: Nov. 30, 1978

[51] Int. Cl.[3] ..... B43K 27/00; B43K 24/02

[52] U.S. Cl. ..... 401/29; 401/34; 401/75; 401/99; 401/116

[58] Field of Search ..... 401/29-34, 401/17, 20, 99, 109-116, 68-79, 52, 195, 87

[56] References Cited

U.S. PATENT DOCUMENTS

| | | | |
|---|---|---|---|
| Re. 22,717 | 2/1946 | Savoie | 401/76 X |
| 311,429 | 1/1885 | Hoagland | 401/30 X |
| 1,372,296 | 3/1921 | Keeran | 401/75 |
| 1,404,138 | 1/1922 | Perrotti | 401/52 |
| 1,501,121 | 7/1924 | Keeran | 401/76 |
| 1,729,240 | 9/1929 | Augenstein | 401/70 X |
| 1,755,326 | 4/1930 | Klagges | 401/52 |
| 1,942,283 | 1/1934 | Hale | 401/72 X |
| 2,103,417 | 12/1937 | Haack | 401/82 |
| 2,173,361 | 9/1939 | Gorrell | 401/52 |
| 2,182,846 | 12/1939 | Hasselquist | 401/77 |
| 2,454,086 | 11/1948 | Randolph | 401/116 |
| 2,513,201 | 6/1950 | Reddeman | 401/31 |
| 2,883,968 | 4/1959 | Vertiz | 401/30 |
| 3,079,894 | 3/1963 | Johmann | 401/31 |
| 3,146,758 | 9/1964 | Zepell | 401/112 X |
| 3,196,838 | 7/1965 | Weisser | 401/111 |
| 3,205,863 | 9/1965 | Rhoades | 401/111 |
| 3,250,254 | 5/1966 | Gerspacher | 401/31 |
| 3,288,116 | 11/1966 | Poritz | 401/29 |
| 3,315,643 | 4/1967 | Eratico | 401/109 |
| 3,544,227 | 12/1970 | Green | 401/110 X |
| 3,597,100 | 8/1971 | Ganz | 401/110 |
| 3,630,629 | 12/1971 | DiSpirito | 401/116 |
| 3,672,783 | 6/1972 | Bajusz | 401/116 |
| 3,700,340 | 10/1972 | Terasaki | 401/33 |
| 3,792,931 | 2/1974 | Ganz | 401/109 |
| 3,801,206 | 4/1974 | Poritz | 401/29 |
| 3,898,008 | 8/1975 | Ganz | 401/30 |
| 3,985,455 | 10/1976 | Wahlberg | 401/30 |

FOREIGN PATENT DOCUMENTS

| | | | |
|---|---|---|---|
| 976412 | 3/1951 | France | 401/116 |
| 783208 | 9/1957 | United Kingdom | 401/34 |

*Primary Examiner*—Edgar S. Burr
*Assistant Examiner*—Steven A. Bratlie
*Attorney, Agent, or Firm*—Richard A. Wise; Leonard J. Janowski

[57] ABSTRACT

A writing instrument includes a cam member and first and second cam follower members arranged to simultaneously project or retract upper and lower members from opposite open ends of a barrel when one barrel section is rotated about a writing instrument longitudinal axis relative to a stationary second barrel section.

18 Claims, 7 Drawing Figures

TWO ENDED RETRACTABLE WRITING INSTRUMENT

BACKGROUND OF THE INVENTION

1. Field of the Invention

This invention relates to writing instruments and, more particularly, to writing instruments adapted to simultaneously project or retract upper and lower members from opposite open ends of a barrel.

2. Description of the Prior Art

Writing instruments having a twist-type mechanism capable of projecting or retracting writing medium assemblies such as pen nibs from opposite open ends of a barrel are well known in the art. However, such writing instruments require a relatively complicated and expensive project or retract mechanism. Some of the prior art writing instruments also rotate the pen nibs during displacement and cause the pen nibs to scrape and wipe ink against the inside surface of the barrel. The collected ink on the inside surface of the barrel could eventually foul the pen nib.

Accordingly, it is desired to provide a writing instrument with a relatively simple and inexpensive project or retract mechanism capable of simultaneously projecting or retracting writing medium assemblies from opposite open ends of a barrel without scraping against an inside surface of the barrel.

SUMMARY OF THE INVENTION

A retractable writing instrument includes a barrel means having a lower section coaxially assembled end-to-end with an upper section so as to be rotatable about a longitudinal axis of the writing instrument. A lower retractable member is coaxially mounted within the lower barrel section to telescopically move in and out of an open end of the lower barrel section. An upper retractable member is coaxially mounted within the upper barrel section to telescopically move in and out of the upper barrel section. A tubular cam means is coaxially mounted within the upper barrel section between the upper and lower retractable members. The cam means has a spiral shaped, first end and a spiral shaped second end, providing first and second spiral paths. A tubular first cam follower member having a key and a bearing surface at one end is disposed within the upper barrel section between the upper retractable member and the cam member with said bearing surface touching the spiral shaped first end. A tubular second cam follower member having a keyway and a bearing surface at one end is disposed within the upper barrel section between the lower retractable member and the cam member with the second cam follower member bearing surface touching the spiral shaped second end and the key slidingly engaged in the keyway. Rotation of the lower section about the writing instrument longitudinal axis causes the first and second cam follower members to simultaneously rotate about the axis following the first and second spiral paths and the upper and lower retractable members to telescopically move in and out of the open ends of the upper and lower sections of the barrel means.

DESCRIPTION OF THE PREFERRED EMBODIMENT

Figure 1:
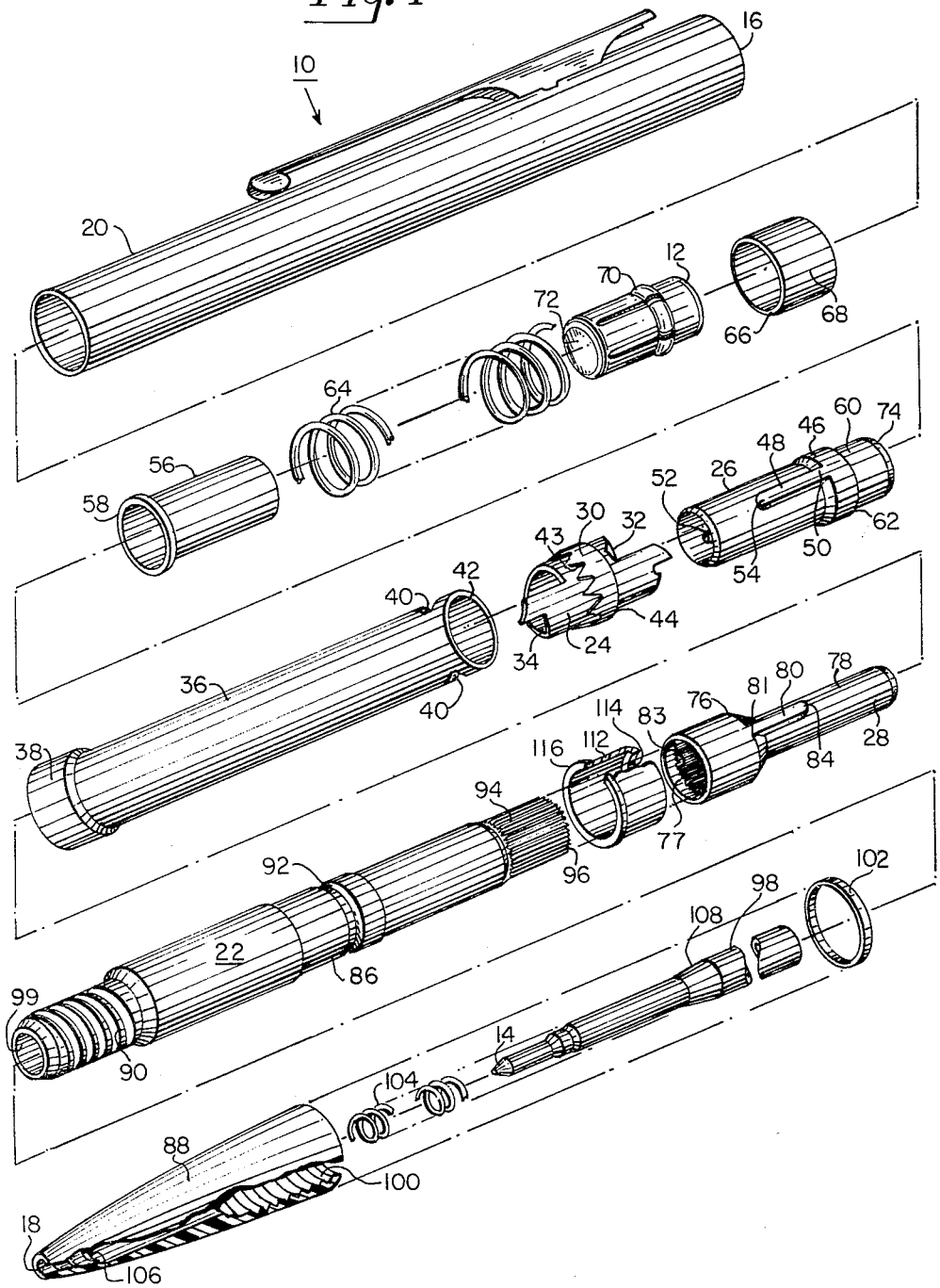
FIG. 1 is an exploded view of a writing instrument arranged according to the invention.
Figure 2:
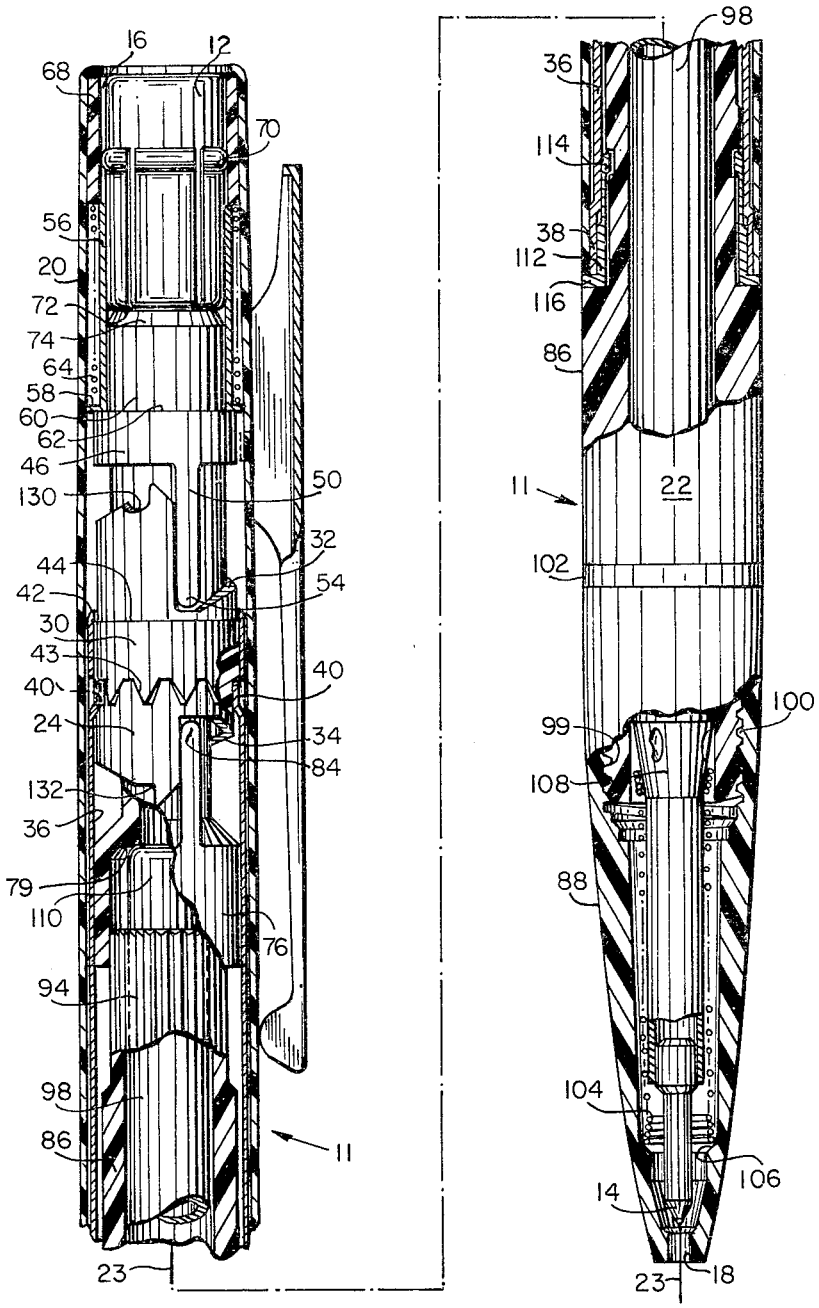
FIG. 2 is a partially sectioned view of the assembled writing instrument.

Referring to FIGS. 1 and 2, there is shown an exploded view and a partially sectioned view of a writing instrument 10 including a barrel 11 containing means for simultaneously projecting or retracting upper 12 and lower 14 members, such as an eraser and writing nib, from opposite open ends 16,18 of the barrel 11. The barrel 11 comprises a coaxial end-to-end assembly of hollow upper 20 and lower 22 barrel sections. The writing instrument is adapted to project or retract the eraser 12 and writing nib 14 when either the lower barrel section 22 or the upper barrel section 20 is rotated about the longitudinal axis 23 of the writing instrument 10. The upper barrel section 20 houses a project or retract mechanism having a hollow cylindrically shaped cam member 24 and first 26 and second 28 cam follower members. The eraser 12 is coupled to the first cam follower member 26 and the writing nib 14 is coupled to the second cam follower member 28. The cam member 24 is encircled by a raised serrated ring 30 and has first 32 and second 34 opposite ends cut in the form of spirals.

As further described below, the spiral shaped ends 32,34 act as cams for imparting a translational movement simultaneously to the first 26 and second 28 cylindrically shaped hollow cam follower members when either the cam member 24 or any one of the cam follower members 26,28 are rotated about the longitudinal axis 23 of the writing instrument 10. The pitch of the first spiral end 32 may be different from the pitch of the second spiral end 34 if the translational displacements of the eraser 12 and writing nib 14 are different.

The cam member 24 and second cam follower member 28 are coaxially disposed inside tubular member 36 having a bell shaped end 38 tightly pressed inside the upper barrel section 20. The tubular member 36 includes locking means arranged to cooperate with the cam member 30 so that the tubular member 36, cam member 24, and upper barrel section 20 will rotate together about the writing instrument axis 23. In the preferred embodiment, the locking means include inwardly projecting protuberances 40 formed near an end 42 of the tubular member 36. The protuberances 40 are forced into the serrations 43 on the ring 30 during assembly and when the tubular member end 42 is peened over a non-serrated edge 44 of the ring. Thus, it will be appreciated that rotation of the upper barrel section 20 about the longitudinal axis 23 of the writing instrument causes rotation of the assembled tubular member 36, and cam member 24 about the same axis 23.

The first cam follower member 26 has a raised ring 46 and ridge 48 on an outside surface. The ridge 48 has one end 50 integrally formed with the ring 46 and is arranged to longitudinally extend in a direction substantially parallel to the longitudinal axis of the first cam follower member 26. A key or ridge 52 is formed on an inside surface of the first cam follower member 26 so as to longitudinally extend in a direction substantially parallel to the ridge 48 on the outside surface. The first cam follower member 26 is assembled in the upper barrel section 20 so that a free end 54 of the ridge 48 bears against an opposing first sprial end 32 of the cam member 24.

A first cylindrical sleeve 56 having an outwardly projecting flange 58 is loosely assembled onto an end 60 of the first cam follower member 26 and against a raised edge 62 of the ring 46. The cam follower end 60 is free to rotate about its longitudinal axis without causing the loose fitting sleeve 56 to also rotate. A helical spring 64 is assembled over the first sleeve 56 so as to be disposed between the flange 58 and an edge 66 of a second cylindrical sleeve 68 coaxially pressed inside the open end 16 of the upper barrel section 20. The helical spring 64 provides a bias force continually urging the first sleeve flange 58 against the first cam follower member 26 and thus, the ridge end 54 of the first cam follower member 26 against the first spiral cam end 32. A suitable eraser 12 and holder 70 is inserted into the open ends of the upper barrel section 20, and first 56, and second 68 sleeves so that a holder end 72 bears against a free end 74 of the first cam follower member 26. The eraser 12 and holder 70 are arranged to reciprocally move in and out of the open end 16 of the upper barrel section 20 without rotating in response to a translational displacement of the first cam follower member 26. The translational displacement of the eraser 12 is determined by the pitch of the first spiral cam end 32.

Figure 7:
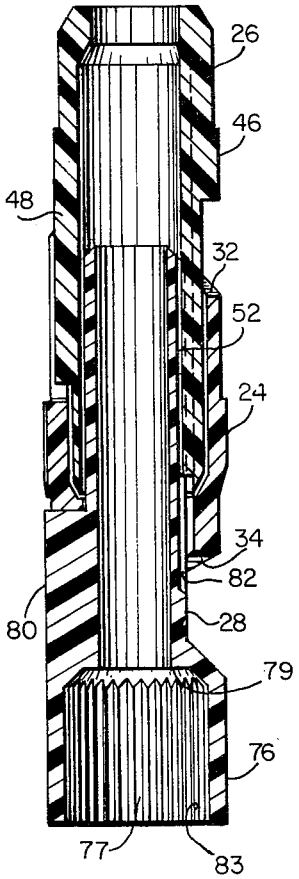
FIG. 7 is a longitudinally sectioned view of the cam member assembled with the first cam follower member and the second cam follower member taken along Lines VII—VII of FIG. 3.
Figure 6:
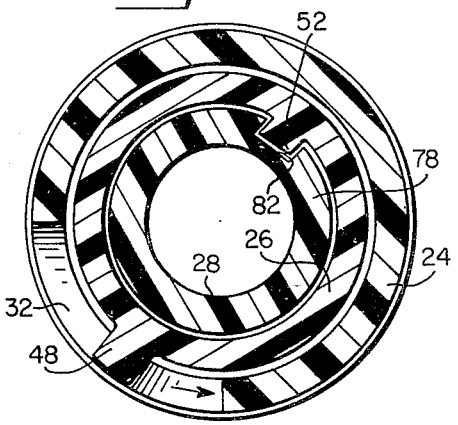
FIG. 6 is a cross-sectional view of a cam member assembled with a first cam follower member and a second cam follower member taken along Lines VI—VI of FIG. 3.

The second cam follower member 28 has a first section 76 with a longitudinally extending hole 77 terminating with a lip 79. The first section 76 has an external surface with a relatively large cross-sectional diameter that linearly tapers inwardly to merge with a second section 78 having a reduced cross-sectional diameter. A ridge 80 having one end 81 integrally formed with the tapered portion of the second cam follower 28 is arranged to longitudinally extend along the outer surface of the second section 78 in a direction substantially parallel to the longitudinal axis of the second cam follower member 28. Longitudinally extending splines 83 are provided on an inside surface of the first section 76 and a longitudinally extending keyway 82 shown in FIGS. 6 and 7 is cut into the second section 78. The second cam follower member 28 is assembled in the tubular member 36 so that a free end 84 of the ridge 80 bears against the opposing second spiral end 34 of the cam member 24.

The lower barrel section 22 includes a tubular mid portion 86 and a tubular lower portion 88. The mid portion 86 has an externally threaded end 90, a radial groove 92 encircling the mid portion 86, and longitudinally extending splines 94 formed on an end 96 opposite the threaded end 90. The mid portion 86 is adapted to be coaxially assembled end-to-end with the second cam follower 28 so that rotation of the lower barrel section 22 causes rotation of the second cam follower member 28 and engaged first cam follower member 26 relative to the stationary cam member 24. In the preferred embodiment, this is accomplished by inserting the mid portion 86 of the lower barrel section 22 into the tubular member 38 and meshing the splined end 94 of the mid portion 86 with the splines 83 on the inside surface of the second cam follower 28. The meshing of the splines 83,94 prevent a rotational displacement of the mid portion 86 relative to the second cam follower 28.

A suitable writing nib 14, such as a ball point at an end of a cartridge 98 containing an erasable ink described in U.S. Pat. No. 4,097,290, is loosely inserted into the mid portion 86 and the hole 77 in the second cam follower member 28. The threaded end 90 of the mid portion 86 is adapted to screw into an internally threaded end 100 of the lower portion 88 to permit easy access to the cartridge 98 assembled therein. A ring 102 is interposed between the lower 88 and mid portions 86 to minimize binding when the lower 88 and mid portions 86 are screwed together. A helical spring 104 is assembled over the nib 14 and inside the lower portion 88 so as to be placed between an internal groove 106 in the lower portion 88 and a tapered section 108 or protuberance on the cartridge 98. The helical spring 104 provides a bias force continually urging an opposite end 110 of the cartridge against the terminus and lip 79 of the hole 77 in the second cam follower member 28, whereby the ridge end 84 on the second cam follower member 28 is forced against the second spiral cam end 34. It will be appreciated that the loose fit of the cartridge 98 in the lower barrel section 22 and second cam follower member 28 allows the writing nib 14 to reciprocally move in and out of the open end 18 of the lower portion 88 without rotating in response to a translational displacement of the second cam follower member 28. The translational displacement of the writing nib 14 is determined by the pitch of the second spiral cam end 34.

Rotational movement of the lower barrel section 22 relative to the upper barrel section 20 is enhanced by use of a sleeve 112 having an inwardly projecting lip 114 or flange on one end and and outwardly projecting flange 116 on an opposite end. The sleeve 112 is assembled over the mid portion 86 so that the inwardly projecting lip 114 is received in the radial groove 92. The inside sleeve diameter is larger than the diameter of the mid portion 86, so that the sleeve may rotate easily about its longitudinal axis without significant interference from the mid portion 86. The bell shaped end 38 of the tubular member 36 is pressed tightly onto the sleeve 112 so that the sleeve 112 and tubular member 36 may rotate as a unit around the longitudinal axis of the writing instrument 10.

Figure 3:
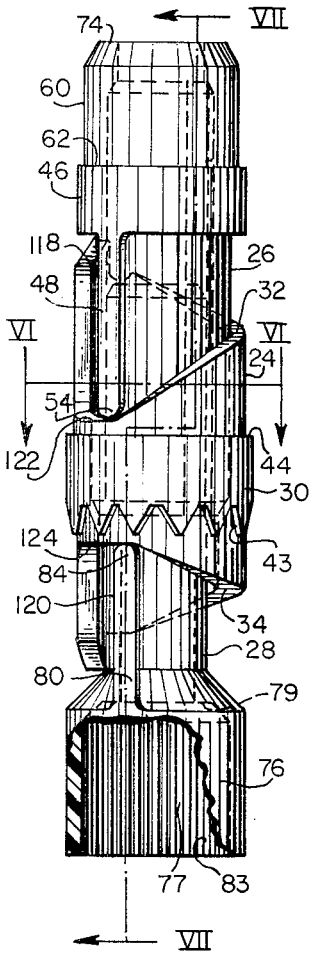
FIGS. 3, 4, and 5 are side views showing rotational and longitudinal displacement of the cam follower members relative to the cam member.
Figure 4:
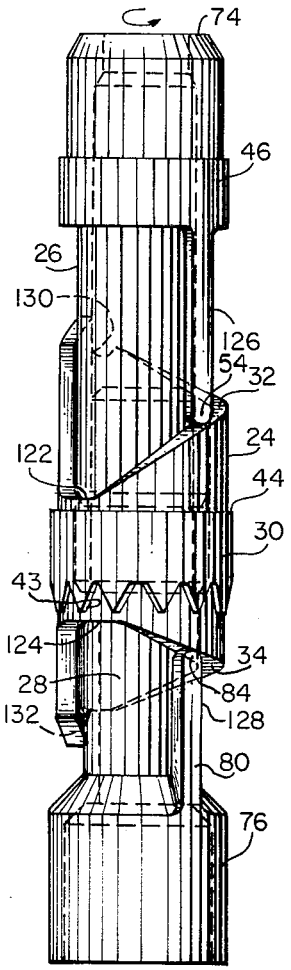
Figure 5:
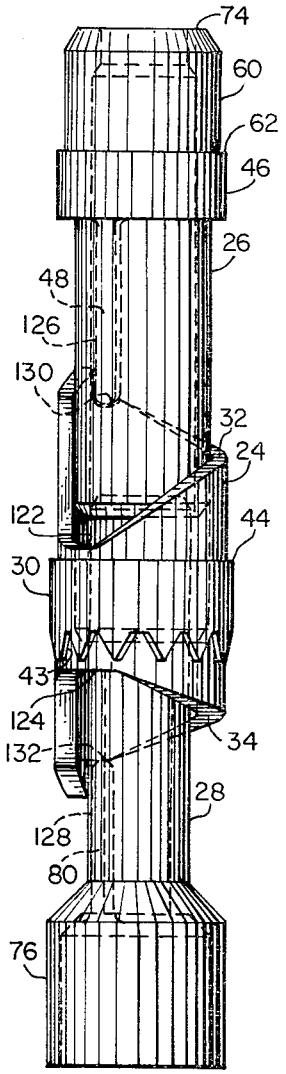

Referring to FIGS. 3, 4, and 5 there is shown front views of the assembled cam 24 and cam follower members 26,28 useful in describing the rotational and translational displacement of the cam follower members 26,28 occuring when the lower barrel section 22 is rotated about the writing instrument longitudinal axis 23 and the upper barrel section 20 is held stationary. FIG. 3 shows the relative positions of the cam 24 and cam follower member 26,28 when the writing nib 14 and eraser 12 are fully retracted within the open ends 18,16 of the lower 22 and upper barrel sections (FIG. 2). In the retracted position, the ridge ends 54,84 and ridge sides 118,120, bear against a first terminus 122,124, of the first 32 and second 34 spiral cam ends. When the upper barrel section 20 is held stationary and the lower barrel section 22 is rotated clockwise about the axis 23, the engaged or connected first 26 and second 28 cam follower members are caused to rotate clockwise about the axis. The direction in which the spiral paths 32, 34 wind around the cam member 24 is selected so that the rotating cam follower members 26,28 will also be translationally displaced. In particular, the spiral paths 32,34 direct the rotating ridge ends 54,84 away from each other, as shown in FIG. 4. The rotation and displacement of the cam follower members 26,28 can continue until the ridge ends 54,84 and sides 126,128 strike a stationary second terminus 130,132 of the first 32 and second 34 spiral cam ends shown in FIG. 5. In this position, the writing nib 14 and eraser 12 project from the open ends 18,16 of the lower 22 and upper 20 barrel sections. It will be understood that the projecting nib 14 and eraser 12 can be retracted by reversing the aforementioned procedure. If the lower barrel section 22 is held stationary, and the upper barrel section 20 is rotated about the axis 23, the cam member 24 is caused to rotate in the same direction about the axis. The rotating spiral cam ends 32,34 push against the ridge ends 54,84 of the cam follower members 26,28 causing them to be translationally displaced without rotation. The translational displacement of the cam follower members 26,28 can continue until either the first or second terminus of the spiral cam ends 32,34 rotationally move against the non-rotating ridges 48,80 of the cam follower members 26,28.

Referring to FIGS. 6 and 7, there is shown a cross-sectional view and a longitudinally sectioned view of the second section 78 of the second cam follower member 28 slidably assembled inside the first cam follower member 26 which in turn is slidably assembled inside the cam member 24. The cam member 24 and cam follower members 26,28 are assembled so that the key 52 on the first cam follower member 26 is received in the keyway 82 of the second cam follower member 28. The key 52 on the first cam follower member 26 is intended to slide in the keyway 82 of the second cam follower member 28 to permit a translational displacement of the cam follower members 26,28 relative to each other. However, the key 52 and keyway 82 cooperatively act to prevent relative rotational movement between the cam follower members 26,28. Thus, rotating the second cam follower member 28 about the axis will cause rotation of the first cam follower member 26.

A writing instrument 10 has been described including a cam 24 and cam followers 26,28 assembled to simultaneously project or retract upper 12 and lower 14 members from opposite open ends 16,18 of the barrel 11. In the preferred embodiment, the lower member 14 is a writing nib in the form of a ball point at one end of a cartridge 98 containing an erasable ink. If desired, any writing nib could be coupled to the second cam follower member 28 in the manner described or a second writing nib could replace the eraser 12 without departing from the invention. Thus, many other arrangements can readily be devised in accordance with the disclosed principle by those skilled in the art.

What is claimed is:

1. A retractable writing instrument comprising:

barrel means having an open ended lower section coaxially assembled end-to-end with an open ended upper section so as to be rotatable about a longitudinal axis of said writing instrument;

a lower retractable member coaxially mounted within said lower barrel section to telescopically move in and out of said open end of said lower barrel section;

an upper retractable member coaxially mounted within said upper barrel section to telescopically move in and out of said open end of said upper barrel section;

tubular cam means coaxially mounted within said upper barrel section between said upper and lower retractable members, said cam means having a spiral shaped first end and a spiral shaped second end providing first and second spiral paths;

a tubular first cam follower member having a key and a bearing surface at one end, said first cam follower member being disposed within said upper barrel section with an opposite end of said first cam follower member bearing against said upper retractable member and said bearing surface touching said spiral shaped first cam end; and a tubular second cam follower member having a keyway and a bearing surface at one end, said second cam follower member being disposed within said upper barrel section with an opposite end of said second cam follower member bearing against said lower retractable member, said opposite end of said second cam follower member being connected to said lower barrel section to rotate together with said second cam follower member bearing surface touching said spiral shaped second cam end and said key slidingly engaged in said keyway, whereby rotation of said lower barrel section about said writing instrument longitudinal axis relative to a stationary upper barrel section causes said first and second cam follower member to simultaneously rotate about said axis following said first and second spiral paths and said upper and lower retractable members to telescopically move in and out of said open ends of said upper and lower sections of said barrel means without rotating.

2. A retractable writing instrument according to claim 1, wherein said lower barrel section has a continuous radial groove on an external surface and a sleeve with an inwardly projecting retaining lip, said sleeve being loosely assembled to said lower barrel section with said retaining lip received in said groove so that said sleeve is independently rotatable about said longitudinal axis of said writing instrument.

3. A retractable writing instrument according to claim 2, further including a tubular member disposed within said upper barrel section with one end connected to said cam means and an opposite end connected to said sleeve to prevent a translational displacement of said cam means.

4. A retractable writing instrument according to claim 3, wherein said cam means is encircled by a serrated ring and protuberances are formed on said one end of said tubular member for engaging said serrated ring.

5. A retractable writing instrument according to claim 1, wherein longitudinally extending splines are formed on an external surface of one end of said lower barrel section for engaging longitudinally extending splines formed on an internal surface of said opposite end of said tubular second cam follower member.

6. A retractable writing instrument according to claim 1, further including resilient means disposed within said upper barrel section for continuously urging said bearing surface on said first cam follower member against said spiral shaped first end of said cam means.

7. A retractable writing instrument according to claim 1, further including resilient means disposed within said lower barrel section for continuously urging said lower retractable member against said opposite end of said second cam follower member and said bearing surface on said second cam follower member against said spiral shaped end of said cam means.

8. A retractable writing instrument according to claim 1, wherein said lower retractable member is a pen nib.

9. A retractable writing instrument according to claim 1, wherein said upper retractable member is an eraser.

10. A retractable writing instrument comprising:

barrel means having an open ended upper section coaxially assembled end-to-end with an open ended lower section so as to be independently rotatable about a longitudinal axis of said writing instrument;

a lower retractable member coaxially mounted within said lower barrel section to telescopically move in and out of said open end of said lower barrel section;

an upper retractable member coaxially mounted within said upper barrel section to telescopically move in and out of said open end of said upper barrel section;

tubular cam means coaxially mounted within said upper barrel section between said upper and lower retractable members, said cam means having a spiral shaped first end and a spiral shaped second end providing first and second paths;

a tubular first cam follower member having a key and a bearing surface at one end, said first cam follower member being disposed within said upper barrel section with an opposite end of said first cam follower member bearing against said upper retractable member and said bearing surface touching said spiral shaped first cam end;

a tubular second cam follower member having a keyway and a bearing surface at one end, said second cam follower member being disposed within said upper barrel section with an opposite end of said second cam follower member bearing against said lower retractable member, said opposite end of said second cam follower member being connected to said lower barrel section with said second cam follower member bearing surface touching said spiral shaped second cam end and said key slidingly engaged in said keyway; and means for connecting said cam means to said upper barrel section and said lower barrel section to enable said cam means and said upper barrel section to rotate together about a longitudinal axis of said writing instrument independent of said lower barrel section, whereby rotation of said upper barrel section about said writing instrument longitudinal axis relative to a stationary lower barrel section causes said cam means to rotate about said axis and only a simultaneous longitudinal displacement of said first and second cam follower memebers, and said upper and lower retractable members.

11. A retractable writing instrument according to claim 10, wherein said lower barrel section has a continuous radial groove on an external surface and a sleeve with an inwardly projecting retaining lip, said sleeve being loosely assembled to said lower barrel section with said retaining lip received in said groove so that said sleeve is independently rotatable about said longitudinal axis of said writing instrument.

12. A retractable writing instrument according to claim 11, wherein said connecting means includes a tubular member disposed within said upper barrel section with one end connected to said cam means and an opposite end connected to said sleeve to prevent a translational displacement of said cam means.

13. A retractable writing instrument according to claim 12, wherein said cam means is encirled by a serrated ring and protuberances are formed on said one end of said tubular member for engaging said serrations on said ring.

14. A retractable writing instrument according to claim 10, wherein longitudinally extending splines are formed on an external surface of one end of said lower barrel section for engaging longitudinally extending splines formed on an internal surface of said opposite end of said tubular second cam follower member.

15. A retractable writing instrument according to claim 10, further including resilient means disposed within said upper barrel section for continuously urging said bearing surface on said first cam follower member against said spiral shaped first end of said cam means.

16. A retractable writing instrument according to claim 10, further including resilient means disposed within said lower barrel section for continuously urging said lower retractable member against said opposite end of said second cam follower member and said bearing surface on said second cam follower member against said spiral shaped second end of said cam means.

17. A retractable writing instrument according to claim 10, wherein said lower retractable member is a pen nib.

18. A retractable writing instrument according to claim 10, wherein said upper retractable member is an eraser.

* * * * *